US008939384B1

(12) United States Patent
Anuskiewicz et al.

(10) Patent No.: US 8,939,384 B1
(45) Date of Patent: Jan. 27, 2015

(54) PLANETARY GEAR DRIVE ROTOR-TYPE SPRINKLER WITH ADJUSTABLE ARC/FULL CIRCLE SELECTION MECHANISM

(75) Inventors: Ronald H. Anuskiewicz, San Diego, CA (US); Aaron J. Palumbo, San Diego, CA (US)

(73) Assignee: Hunter Industries, Inc., San Marcos, CA (US)

( * ) Notice: Subject to any disclaimer, the term of this patent is extended or adjusted under 35 U.S.C. 154(b) by 507 days.

(21) Appl. No.: 13/343,456

(22) Filed: Jan. 4, 2012

(51) Int. Cl.
*B05B 15/10* (2006.01)

(52) U.S. Cl.
USPC ..... 239/206; 239/203

(58) Field of Classification Search
CPC ..... B05B 3/04; B05B 5/10; A01G 25/00
USPC ..... 239/203, 204, 206, 451, 452, 459
See application file for complete search history.

(56) References Cited

U.S. PATENT DOCUMENTS

| | | | | |
|---|---|---|---|---|
| 5,058,806 | A | 10/1991 | Rupar | |
| 5,288,022 | A | 2/1994 | Sesser | |
| 5,375,768 | A | 12/1994 | Clark | |
| 5,423,486 | A | 6/1995 | Hunter | |
| 5,456,411 | A | 10/1995 | Scott et al. | |
| 5,556,036 | A | 9/1996 | Chase | |
| 5,699,962 | A | 12/1997 | Scott et al. | |
| 5,711,486 | A | 1/1998 | Clark et al. | |
| 5,720,435 | A | 2/1998 | Hunter | |
| 5,762,270 | A | 6/1998 | Kearby et al. | |
| 5,918,812 | A | 7/1999 | Beutler | |
| 5,927,607 | A | 7/1999 | Scott | |
| 5,988,523 | A | 11/1999 | Scott | |
| 6,042,021 | A | 3/2000 | Clark | 239/205 |
| 6,050,502 | A * | 4/2000 | Clark | 239/237 |
| 6,082,632 | A | 7/2000 | Clark et al. | |
| 6,138,924 | A | 10/2000 | Hunter et al. | |
| 6,227,455 | B1 | 5/2001 | Scott et al. | 239/1 |
| 6,241,158 | B1 | 6/2001 | Clark et al. | |
| 6,244,521 | B1 | 6/2001 | Sesser | |
| 6,299,075 | B1 | 10/2001 | Koller | |
| 6,457,656 | B1 | 10/2002 | Scott | |
| 6,491,235 | B1 | 12/2002 | Scott et al. | 239/206 |
| 6,499,672 | B1 | 12/2002 | Sesser | |
| 6,651,905 | B2 | 11/2003 | Sesser et al. | |
| 6,688,539 | B2 | 2/2004 | Vander Griend | |
| 6,695,223 | B2 | 2/2004 | Beutler et al. | |
| 6,732,950 | B2 * | 5/2004 | Ingham et al. | 239/205 |
| 6,736,332 | B2 | 5/2004 | Sesser et al. | |
| 6,817,543 | B2 | 11/2004 | Clark | |
| 6,854,664 | B2 | 2/2005 | Smith | |
| 6,869,026 | B2 * | 3/2005 | McKenzie et al. | 239/237 |
| 6,871,795 | B2 | 3/2005 | Anuskiewicz | |
| 6,945,471 | B2 * | 9/2005 | McKenzie et al. | 239/237 |
| 6,957,782 | B2 | 10/2005 | Clark et al. | |
| 7,032,836 | B2 | 4/2006 | Sesser et al. | |

(Continued)

*Primary Examiner* — Davis Hwu
(74) *Attorney, Agent, or Firm* — Knobbe Martens Olson & Bear LLP

(57) ABSTRACT

An irrigation sprinkler includes a riser and a nozzle turret rotatably mounted at an upper end of the riser. A drive assembly is supported in the riser and is coupled to the nozzle turret for rotating the nozzle turret. The drive assembly has a reversing planetary gear drive, a reversing mechanism, and a manually adjustable arc setting mechanism including a pair of arc tabs. A position of one of the arc tabs is adjustable through the arc setting mechanism to change a size of an angle through which the nozzle turret oscillates back and forth. The manually adjustable arc setting mechanism is further adjustable to allow the nozzle turret to continuously rotate.

20 Claims, 15 Drawing Sheets

(56) References Cited

U.S. PATENT DOCUMENTS

| | | | | |
|---|---|---|---|---|
| 7,040,553 | B2 | 5/2006 | Clark | |
| 7,159,795 | B2 | 1/2007 | Sesser et al. | |
| 7,240,860 | B2 | 7/2007 | Vander Griend | |
| 7,287,711 | B2 | 10/2007 | Crooks | |
| 7,303,147 | B1 | 12/2007 | Danner et al. | |
| 7,322,533 | B2 | 1/2008 | Grizzle | |
| D593,182 | S | 5/2009 | Anuskiewicz | |
| 7,530,504 | B1 | 5/2009 | Danner et al. | |
| 7,611,077 | B2 | 11/2009 | Sesser et al. | |
| 7,621,467 | B1 | 11/2009 | Garcia | |
| 7,677,469 | B1 | 3/2010 | Clark | |
| 7,748,646 | B2 | 7/2010 | Clark | |
| 7,828,230 | B1 | 11/2010 | Anuskiewicz et al. | |
| 7,861,948 | B1 | 1/2011 | Crooks | |
| 8,469,288 | B1 * | 6/2013 | Clark et al. | 239/242 |
| 2005/0133619 | A1 | 6/2005 | Clark | |
| 2009/0224070 | A1 | 9/2009 | Clark et al. | |
| 2011/0024522 | A1 | 2/2011 | Anuskiewicz | |

* cited by examiner

PLANETARY GEAR DRIVE ROTOR-TYPE SPRINKLER WITH ADJUSTABLE ARC/FULL CIRCLE SELECTION MECHANISM

CROSS-REFERENCE TO RELATED APPLICATIONS

This application is related by subject matter to co-pending U.S. patent application Ser. No. 12/710,265 filed Feb. 22, 2010 by Michael L. Clark et. al. entitled "Reversing Mechanism for an Irrigation Sprinkler with a Reversing Gear Drive" which is a continuation-in-part of U.S. patent application Ser. No. 11/761,911 filed Jun. 12, 2007 by Michael L. Clark entitled "Sprinkler with Reversing Planetary Gear Drive" now U.S. Pat. No. 7,677,469 granted Mar. 16, 2010. This application is also related by subject matter to co-pending U.S. patent application Ser. No. 12/710,298 filed Feb. 22, 2010 by Michael L. Clark et al. entitled "Irrigation Sprinkler with Reversing Planetary Gear Drive Including Two Ring Gears with Different Profiles." This application is also related by subject matter to co-pending U.S. patent application Ser. No. 13/343,522 filed on even date herewith by Michael L. Clark et al. entitled "Rotor-Type Irrigation Sprinkler with Coarse and Fine Arc Adjustment." Said applications and patent are all assigned to Hunter Industries, Inc., the assignee of the subject application. The entire disclosures of the aforementioned applications and patent are hereby incorporated by reference.

FIELD OF THE INVENTION

The present invention relates to apparatus for irrigating turf and other landscape vegetation, and more particularly, to rotor-type sprinklers having a turbine that rotates a nozzle through a gear train reduction.

BACKGROUND OF THE INVENTION

In many parts of the world, rainfall is insufficient and/or too irregular to keep turf and other landscape vegetation green and therefore irrigation systems are installed. Such systems typically include a plurality of underground pipes connected to sprinklers and valves, the latter being controlled by an electronic irrigation controller. One of the most popular types of sprinklers is a pop-up rotor-type sprinkler. In this type of sprinkler a tubular riser is normally retracted into an outer cylindrical case by a coil spring. The case is buried in the ground and when pressurized water is fed to the sprinkler the riser extends. A turbine and a gear train reduction are mounted in the riser for rotating a nozzle turret at the top of the riser. The gear train reduction is often encased in its own housing that is commonly referred to as a gear box. A reversing mechanism is also normally mounted in the riser along with an arc adjustment mechanism.

The gear drive of a typical rotor-type sprinkler can include a series of staggered gears and shafts wherein a small gear on the top of the turbine shaft drives a large gear on the lower end of an adjacent second shaft. Another small gear on the top of the second shaft drives a large gear on the lower end of a third shaft, and so on. Alternatively, the gear drive can comprise a planetary arrangement in which a central shaft carries a sun gear that simultaneously drives several planetary gears on rotating circular partitions or stages that transmit reduced speed rotary motion to a succession of similar rotating stages. The planetary gears of the stages engage corresponding ring gears formed on the inner surface of the housing. See, for example, U.S. Pat. No. 5,662,545 granted to Zimmerman et al.

Two basic types of reversing mechanisms have been employed in commercial rotor-type sprinklers. In one design a reversing stator switches water jets that alternately drive the turbine from opposite sides to reverse the rotation of the turbine and the gear drive. See for example, U.S. Pat. No. 4,625,914 granted to Sexton et al. The reversing stator design typically employs a long metal shaft that can twist relative to components rigidly mounted on the shaft and therefore this arrangement undesirably changes the reversal points. Stopping the rotation of the stator and changing direction of rotation via alternate water jets does not provide for repeatable precise arc limits. In addition, persons that manually set the arc of rotor-type sprinklers that employ a reversing stator design do not get a tactile feel for a stop at the set arc limits.

A more popular design for the reversing mechanism of a rotor-type sprinkler includes four pinion gears meshed together and mounted between arc-shaped upper and lower frames that rock back and forth with the aid of Omega-shaped over-center springs. One of the inner pinion gears is driven by the gear train reduction. The pinion gears on opposite ends of the frames alternately engage a bull gear assembly to rotate the nozzle back and forth between pre-set arc limits. The arc limits are effectuated by a shift dog alternately engaging an adjustable arc tab and a fixed arc tab. See for example, U.S. Pat. Nos. 3,107,056; 4,568,024; 4,624,412; 4,718,605; and 4,948,052, all granted to Edwin J. Hunter, the founder of Hunter Industries, Inc., the assignee of the subject application. While the reversing frame design has been enormously successful, it is not without its own shortcomings. It involves a complicated assembly with many parts that can have operational failures. The main drawback of the reversing frame design is that the pinion gears are held in contact to the outer bull gear with a spring force that is relatively weak. Therefore, high speed torque forces which are sometimes generated in this type of sprinkler can cause the reversing frame gears to slip out of engagement or wear out.

At some irrigation sites it is important to utilize a sprinkler that can be set so that its nozzle oscillates between selected arc limits, or in the alternative, set so that its nozzle will rotate continuously to provide three hundred and sixty degrees of coverage. U.S. Pat. No. 7,861,948 of Crooks discloses a rotor-type sprinkler having a reversing frame design that allows adjustable arc selection or in the alternative, full circle mode operation to be selected. While this rotor-type sprinkler has experienced considerable commercial success, its reversing mechanism is not suitable for a more robust rotor-type sprinkler with a planetary gear drive of the type disclosed in the aforementioned U.S. Pat. No. 7,677,469.

SUMMARY OF THE INVENTION

In accordance with the present invention an irrigation sprinkler includes a riser and a nozzle turret rotatably mounted at an upper end of the riser. A drive assembly is supported in the riser and is coupled to the nozzle turret for rotating the nozzle turret. The drive assembly has a reversing planetary gear drive, a reversing mechanism, and a manually adjustable arc setting mechanism including a pair of arc tabs. A position of one of the arc tabs is adjustable through the arc setting mechanism to change a size of an angle through which the nozzle turret oscillates back and forth. The manually adjustable arc setting mechanism is further adjustable to allow the nozzle turret to continuously rotate.

BRIEF DESCRIPTION OF THE DRAWINGS

Throughout the drawing figures like reference numerals refer to like parts.

DETAILED DESCRIPTION

Figure 1:
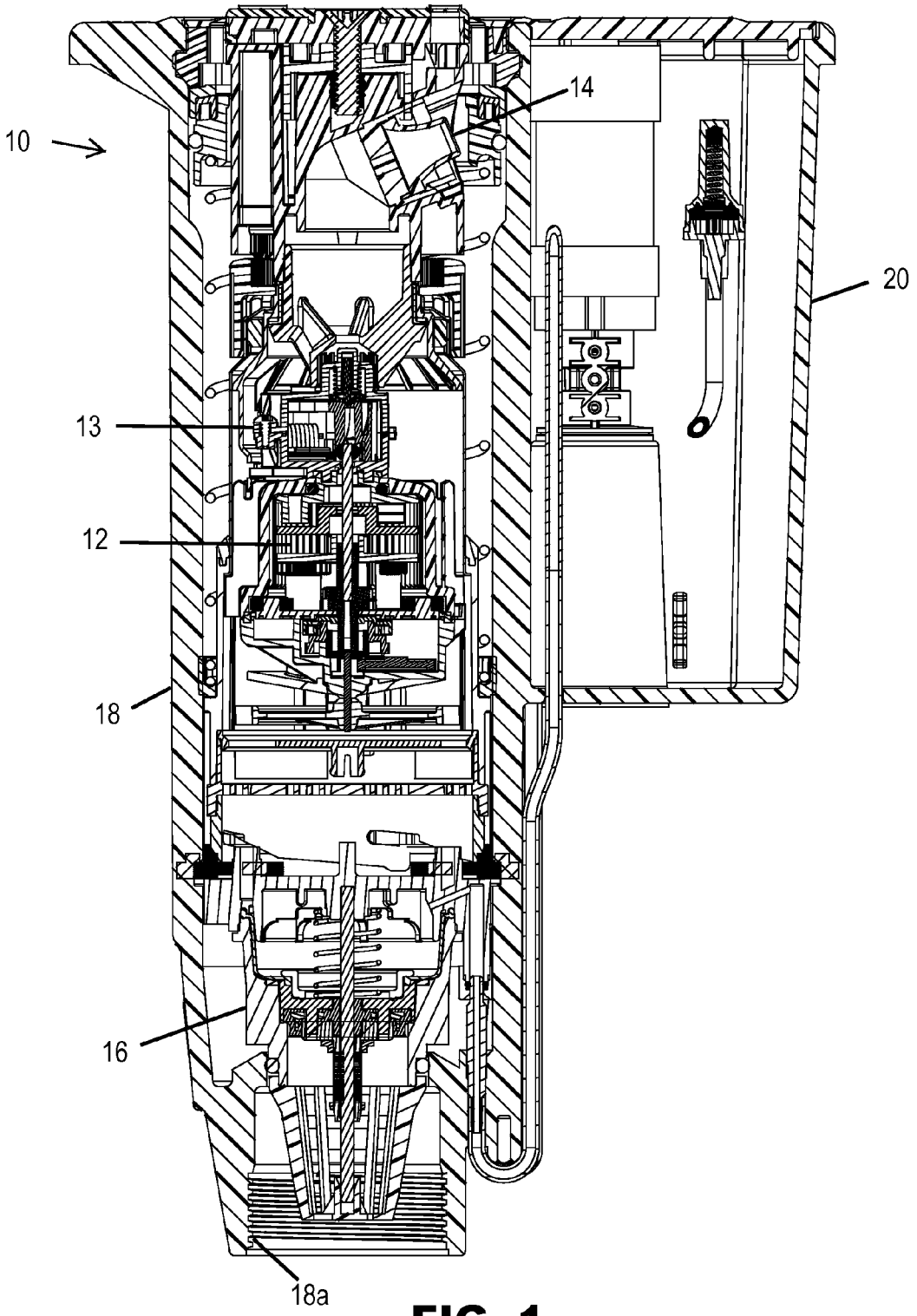
FIG. 1 is a vertical sectional view of a rotor-type sprinkler incorporating an embodiment of the present invention.

Referring to FIG. 1, in accordance with an embodiment of the present invention a pop-up rotor-type sprinkler 10 incorporates a reversing planetary gear drive 12 that, along with a reversing mechanism 13 external to the planetary gear drive 12, either oscillates a nozzle 14 back and forth between pre-set arc limits or continuously rotates the nozzle 14 around a vertical central axis of the sprinkler 10. A manually adjustable arc setting mechanism incorporated in the sprinkler 10 allows a user to set an arc of coverage in an oscillation mode or to select continuous full circle rotation of the nozzle 14 in a uni-directional mode. The sprinkler 10 has a construction similar to that disclosed in the aforementioned U.S. patent application Ser. No. 12/710,265. Except for its springs, the shafts in the planetary gear drive 12, and the toggle in its reversing mechanism 13, the other components of the sprinkler 10 are generally made of injection molded plastic.

Figure 2:
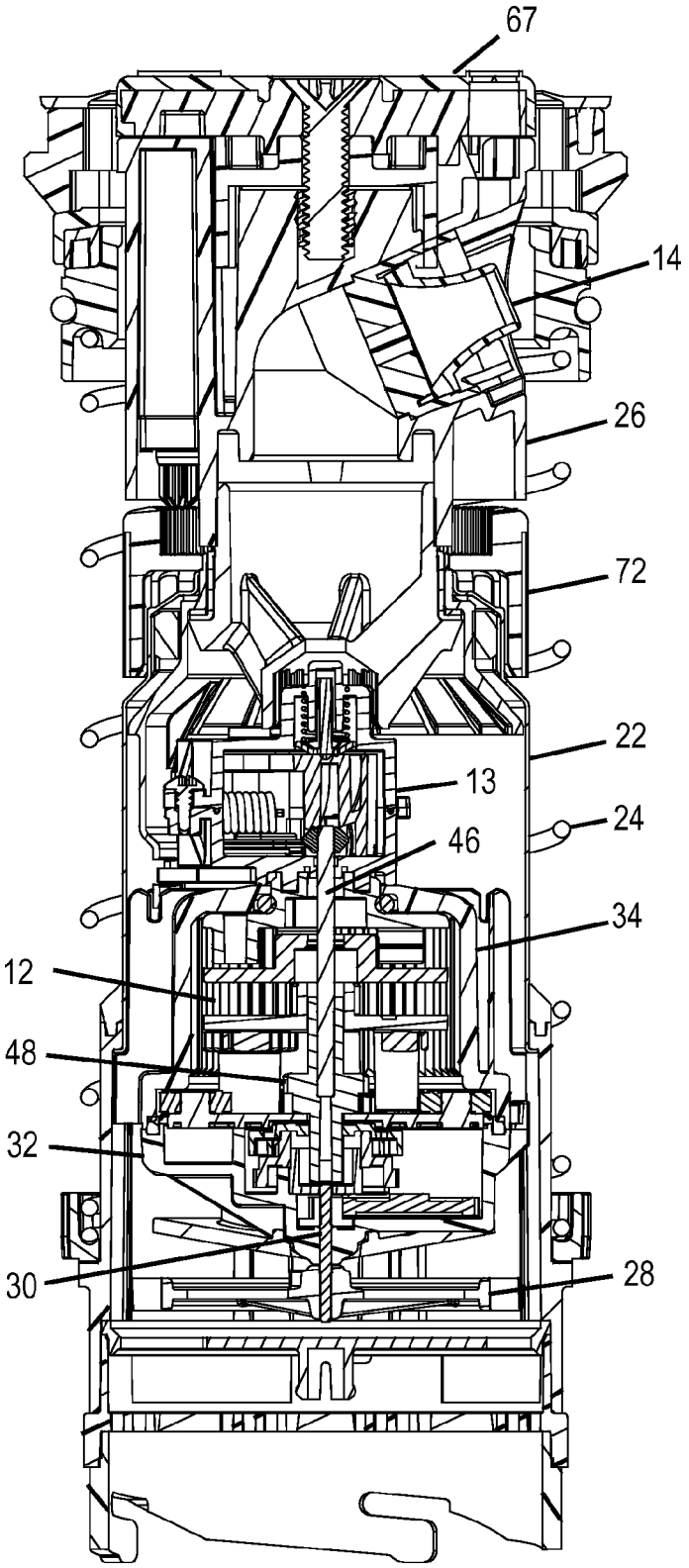
FIG. 2 is an enlarged fragmentary vertical sectional view of the riser and nozzle turret of the sprinkler of FIG. 1.

The sprinkler 10 is a so-called valve-in-head sprinkler that incorporates a valve 16 in the bottom of a generally cylindrical outer case 18 which is opened and closed by valve actuator components (not illustrated) contained in a generally rectangular housing 20 formed on the top two thirds of the side of the outer case 18. The sprinkler 10 includes a generally tubular riser 22 (FIG. 2). A large stainless steel coil spring 24 surrounds the riser 22 and normally holds the riser 22 in a retracted position within the outer case 18. The nozzle 14 is removably inserted in a socket formed inside a cylindrical nozzle turret 26 rotatably mounted at the upper end of the riser 22. The coil spring 24 is compressible to allow the riser 22 and nozzle turret 26 to telescope from their retracted positions to their extended positions when pressurized water is introduced into the female threaded inlet 18*a* (FIG. 1) formed at the lower end of the outer case 18.

The valve 16 (FIG. 1) mounted in the lower part of the outer case 18 may be provided in the form of a removable valve module which can be accessed from the top of the outer case 18 when the riser 22 has been removed. This avoids having to dig up the sprinkler 10 to replace the same. See U.S. Pat. No. 6,227,455 granted May 8, 2001 to Scott et al. entitled "Sub-Surface Sprinkler with Surface Accessible Valve Actuator Components", and U.S. Pat. No. 6,491,235 granted Dec. 10, 2002 to Scott et al. entitled "Pop-Up Sprinkler with Top-Serviceable Diaphragm Valve Module", the entire contents of both of which are hereby incorporated by reference. Both of the aforementioned patents are also assigned to Hunter Industries, Inc.

Figure 3A:
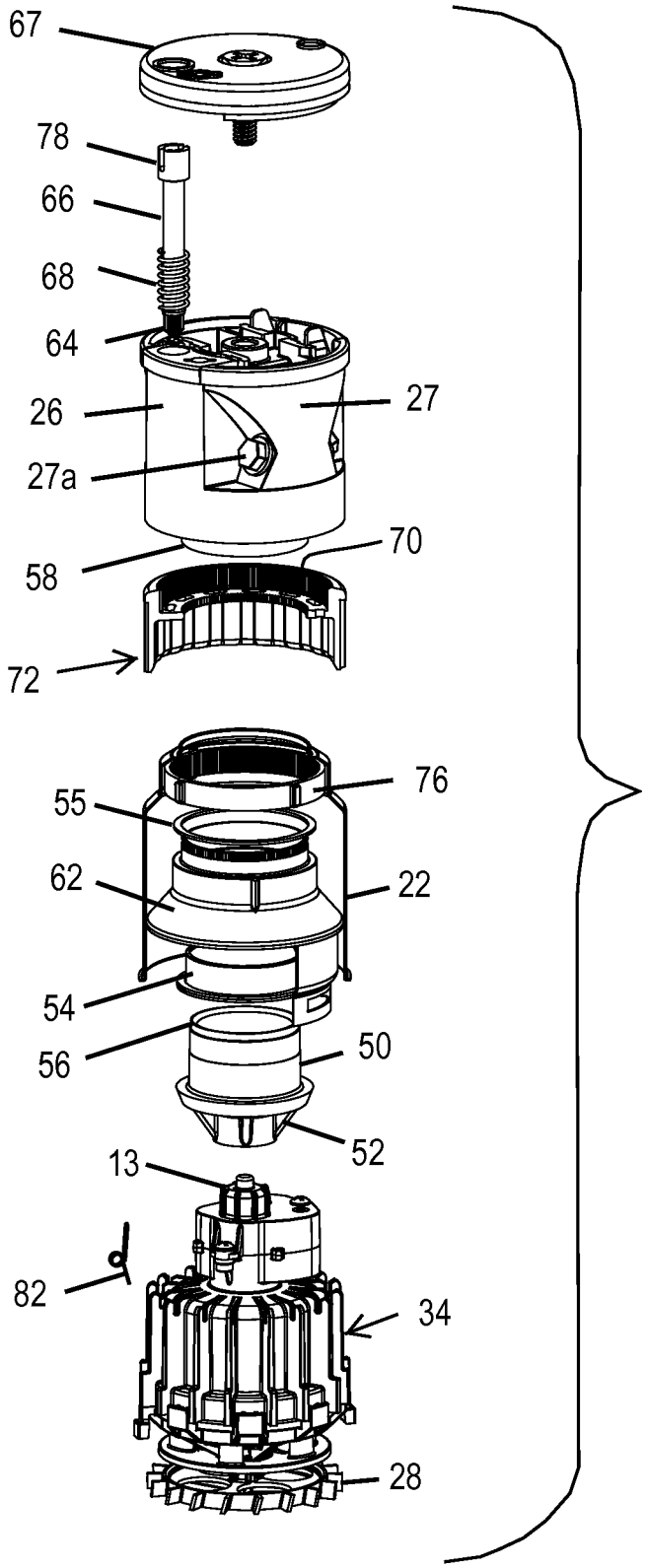
FIG. 3A is a reduced exploded isometric view of the reversing planetary gear drive, additional reversing mechanism, and nozzle turret of the sprinkler of FIG. 1. The ring gear of the sprinkler is vertically sectioned in this figure.

The sprinkler 10 includes a removable secondary nozzle holder 27 (FIG. 3A) that forms a part of the nozzle turret 26. The removable secondary nozzle holder 27 is configured for installing secondary nozzles (not illustrated) or secondary port plugs such as 27*a*. The nozzle 14 serves as the primary nozzle and is installed in a primary nozzle socket formed in the nozzle turret 26. Further details of the removable secondary nozzle holder 27 are disclosed in co-pending U.S. patent application Ser. No. 13/154,698 filed Jun. 7, 2011 by Michael L. Clark et al. and entitled "Irrigation Sprinkler with Reconfigurable Secondary Nozzle Holder", also assigned to Hunter Industries, Inc., the entire disclosure of which is hereby incorporated by reference.

The planetary gear drive 12 and the reversing mechanism 13 provide a drive assembly that is supported inside the riser 22 and is coupled to the nozzle turret 26 for oscillating the nozzle turret 26 back and forth between pre-set arc limits or for continuously rotating the nozzle turret 26 in a circular fashion, as hereafter described in detail. FIG. 2 illustrates details of the riser 22, nozzle turret 26 and reversing planetary gear drive 12. An impeller in the form of a turbine 28 is rigidly secured to the lower end of a vertically oriented drive shaft 30. The turbine 28 thus is coupled to an input stage of the planetary gear drive 12. The drive shaft 30 extends through the lower cap 32 of a cylindrical gear box housing 34 of the reversing planetary gear drive 12. The reversing planetary gear drive 12 has a centrally located main control shaft 46. The lower end of the control shaft 46 is rigidly and co-axially coupled to a bi-level shift sun gear 48 which is vertically reciprocated by axial movement of the control shaft 46 between a raised state and a lowered state. The reversing planetary gear drive 12 further includes additional sun gears and planet gears as disclosed in detail in the aforementioned U.S. patent application Ser. No. 12/710,298.

The bi-level shift sun gear 48 (FIG. 2) is spring biased both upwardly and downwardly from an intermediate neutral position by an over-center spring mechanism (not illustrated) that is located inside the reversing mechanism 13. This ensures that when the sprinkler 10 is in its oscillating mode, the planetary gear drive 12 will be in one of two driving states, either rotating the nozzle 14 clockwise or rotating the nozzle 14 counter-clockwise. As it rotates, the reversing mechanism 13 supports and rotates the nozzle turret 26. A coupling sleeve 50 (FIG. 3A) has an internally splined and tapered lower end 52 that fits over, and rotationally locks with, a plurality of circumferentially spaced, radially projecting ribs 13*a* (FIG. 9) of a central hub 13*b* that is formed on the top of the reversing mechanism 13. A cylindrical hub 58 (FIG. 3A) formed on the lower end of the nozzle turret 26 is mounted to, and secured in a fixed manner, with an upper cylindrical portion 56 of the coupling sleeve 50. A cylindrical flanged bearing 54 and a cylindrical flanged thrust bearing 55 provide smooth annular surfaces that allow the coupling sleeve 50 and the nozzle turret 26 to rotate freely relative to the normally non-rotating carrier ring 62 and the non-rotating riser 22.

The relatively high RPM of the turbine 28 is successively reduced by the planetary gear drive 12 so that the final output RPM is relatively low, and the output torque at the uppermost carrier of the planetary gear drive 12 is relatively high. For example, the turbine 28 may rotate at eight hundred RPM and the central section of the uppermost carrier inside the planetary gear drive 12 may rotate at an RPM of less than one. The sprinkler 10 uses the planetary gear drive 12 and the additional reversing mechanism 13 to change the direction of rotation of the nozzle turret 26. Thus the overall reversing mechanism of the sprinkler 10 has two portions, namely, the components of the reversing mechanism 13 that are located externally of the gear box housing 34, and another portion that is contained within the planetary gear drive 12 that includes the bi-level shifting sun gear 48, as well as planetary gears, idler gears and ring gears. The advantage of including at least a portion of the overall reversing mechanism inside the planetary gear drive 12 is that the shifting can be done in a low torque region of the planetary gear drive 12 where damage and wear to gears is much less likely to occur. This eliminates the need to use conventional arc-shaped shifting frames with delicate pinion gears that engage a bull gear assembly and bear large loads. The planetary gear drive 12 can deliver relatively high rotational torque to the nozzle turret 26 in a manner that is useful in large rotor-type sprinklers of the type that are employed to water large areas such as golf courses and playing fields. Such high torque may prematurely wear out and/or strip conventional pivoting gear train reversing mechanisms. Different gear tooth profiles of the ring gears that are molded on the inner wall of the gear box housing 34 and the upper and lower stages of the bi-level shift sun gear 48 desirably result in the nozzle 14 rotating in both the clockwise and counter-clockwise directions at the same, substantially uniform, predetermined speed of rotation.

High output torque is important for large area irrigation sprinklers. Sprinklers of this type can discharge seventy-five gallons of water per minute (GPM) at one-hundred and twenty pounds per square inch (PSI) throwing water one hundred and fifteen feet from the sprinkler. Discharging water at such a high flow rate and high pressure creates substantial downward and radial forces on the nozzle turret 26 that result in significant drag and resistance to rotation of this key component of a rotor-type sprinkler. The gear drives utilized in this type of sprinkler must overcome this resistance. The drive assembly sprinkler 10 is capable of operating at the high levels of performance required for large area irrigation sprinklers while providing both arc adjust and full circle modes of operation, and at the same time, reducing wear and increasing reliability.

Figure 5:
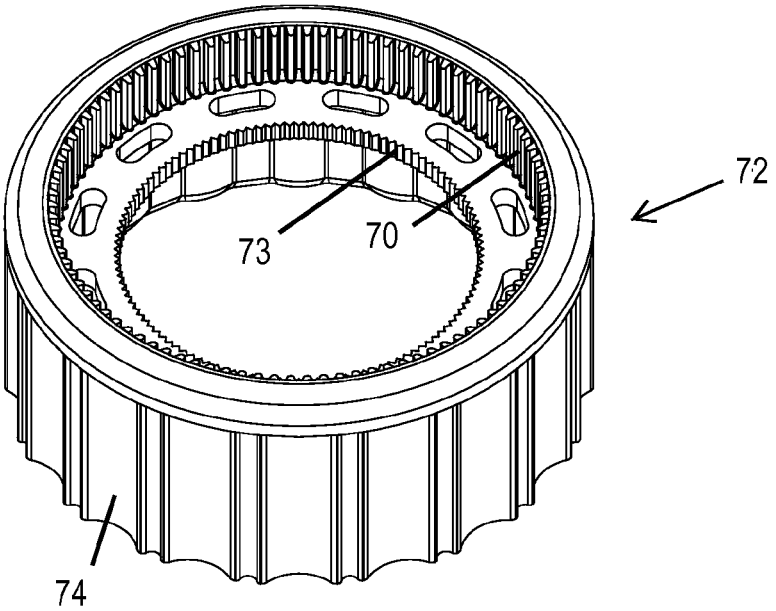
FIG. 5 is an enlarged isometric view of the side adjusting ring of the sprinkler of FIG. 1 taken from the top side thereof.

The fast spinning turbine 28 can slowly rotate the nozzle turret 26 through the reversing planetary gear drive 12 and the additional reversing mechanism 13. The additional reversing mechanism 13 includes cams and components that lift and drop the output shaft 46. Details of the reversing mechanism 13 are disclosed in the aforementioned U.S. patent application Ser. No. 12/710,265. A carrier ring 62 (FIGS. 3A, 3B and 4) and an adjusting gear 64 (FIGS. 3A and 3B) cooperate with the reversing mechanism 13 to permit manual user adjustment of the size of the arc of oscillation of the nozzle 14 carried in the nozzle turret 26, which in turn determines the area of coverage of the sprinkler 10, i.e. the size and shape of the area watered by the sprinkler 10. The adjusting gear 64 is formed on the lower end of an arc adjusting shaft 66 that extends through a sleeve (not illustrated) formed inside the nozzle turret 26. The arc adjusting shaft 66 extends through a disc-shaped elastomeric top cover 67 (FIG. 3A) of the nozzle turret 26 and through a coil spring 68. The coil spring 68 normally elevates the adjusting gear 64 away from a ring gear 70 (FIGS. 3A and 5) formed on the inside of a side adjusting ring 72 (FIG. 5) during normal operation of the sprinkler 10 to allow the nozzle turret 26 to rotate relative to the side adjusting ring 72. The side adjusting ring 72 is formed with a plurality of circumferentially spaced, axially extending exterior channels 74. The exterior channels 74 allow the operator to firmly grip the adjusting ring to make an arc adjustment. A plurality of inwardly projecting teeth 73 mesh with the radially outwardly projecting teeth 62*a* (FIG. 4) formed on the upper end of the carrier ring 62 to rotationally couple the side adjusting ring 72 to the carrier ring 62.

Figure 3B:
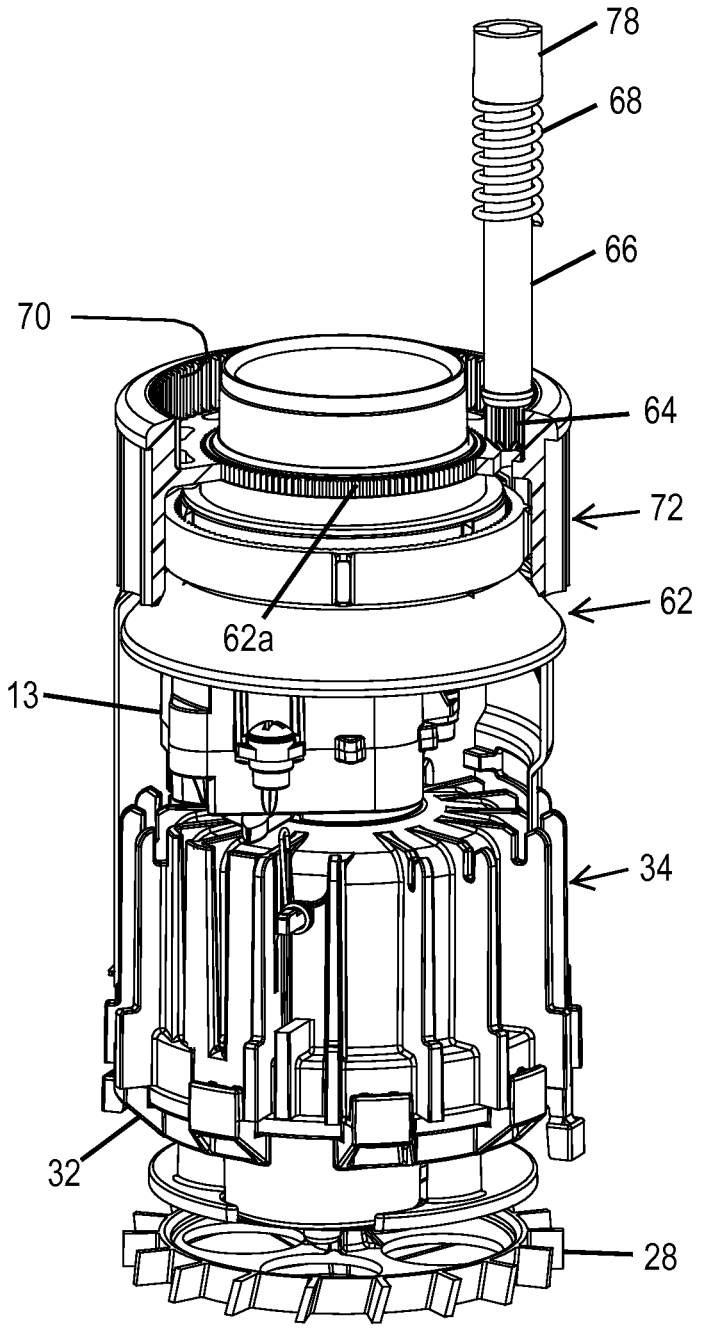
FIG. 3B is an enlarged assembled view of a portion of FIG. 3A illustrating details of the engagement of the adjusting gear and ring gear of the sprinkler of FIG. 1.
Figure 8:
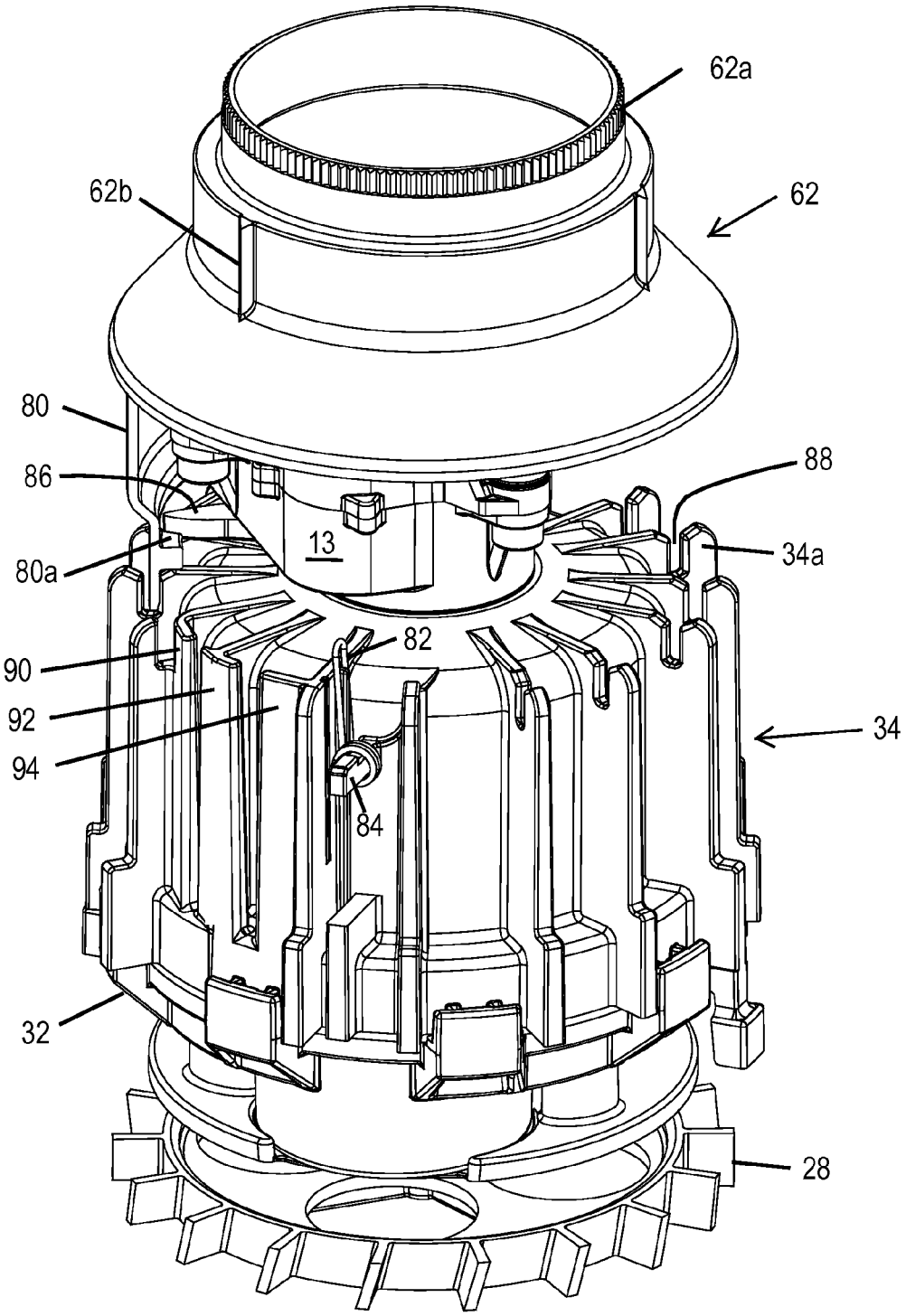
FIG. 8 is a further enlarged portion of FIG. 3B with the arc adjusting shaft and the side adjusting ring removed and with the reversing mechanism in a different rotational position.

An upper end 78 (FIG. 3A) of the arc adjusting shaft 66 is formed with a socket that can be engaged with the end of a HUNTER® tool (not illustrated). The configuration of the Hunter tool is illustrated in FIG. 8 of U.S. Pat. No. 6,042,021 granted Mar. 28, 2000 to Mike Clark and entitled "Arc Adjustable Tool Locking Mechanism for Pop-Up Rotary Sprinkler", the entire disclosure of which is hereby incorporated by reference. Said patent is also assigned to Hunter Industries, Inc. The user can exert downward pressure on the arc adjusting shaft 66 with the HUNTER tool in order to overcome the force of the spring 68 and engage the adjusting gear 64 with the ring gear 70 as illustrated in FIG. 3B to adjust the arc of coverage of the sprinkler 10 when the sprinkler 10 is set to operate in an oscillating mode. The combination of the arc adjusting shaft 66, the ring gear 70 and arc tabs hereafter described provides a manually adjustable arc setting mechanism which allows fine adjustment of the size of the arc of oscillation of the sprinkler 10. The fine adjustment capability is due to the gear reduction achieved by the relatively small number of teeth on the adjusting gear 64 compared to the relatively large number of teeth on the ring gear 70.

The side adjusting ring 72 (FIGS. 3A and 3B) and arc tabs provides an alternative manually adjustable arc setting mechanism. When the riser 22 is extended from the outer case 18, the user can grasp the exterior of the side adjusting ring 72 between a thumb and index finger on one hand and rotate the side adjusting ring 72. This rotational motion of the side adjusting ring 72 directly rotates the carrier ring 62 to effectuate coarse adjustments in the arc of coverage of the sprinkler 10 when the sprinkler 10 is set to operate in its oscillating mode.

Figure 7:
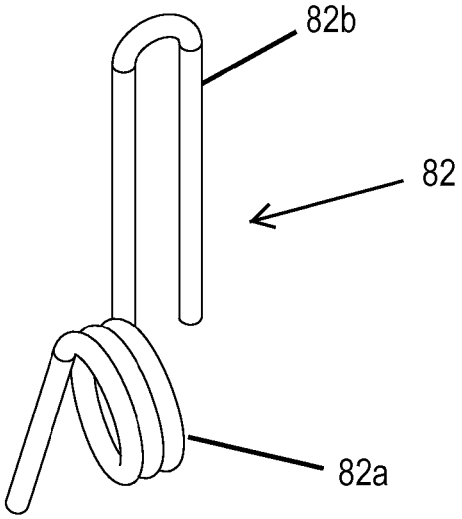
FIG. 7 is a greatly enlarged isometric view of the torsion spring that forms the fixed arc tab of the sprinkler of FIG. 1.

The angle or size of the arc of oscillation of the nozzle turret 26 and the nozzle 14 carried therein is determined by the circumferential position of an adjustable arc tab 80 (FIG. 4) relative to a fixed arc tab 82 (FIG. 8). Only the circumferential position of the adjustable arc tab 80 can be manually adjusted by the user. The fixed arc tab 82 is mounted to the exterior of the gear box housing 34. The adjustable arc tab 80 is integrally formed on the side of the outer rim of the carrier ring 62 (FIG. 4) and extends downwardly therefrom. The fixed arc tab 82 (FIG. 7) comprises a stainless steel torsion spring that is formed with a lower coiled segment 82*a* and an upper inverted U-shaped segment 82*b*. The coiled segment 82*a* of the torsion spring surrounds a supporting arm 84 (FIG. 8) that extends radially from the outer vertical wall of the cylindrical gear box housing 34 of the reversing planetary gear drive 12. The fixed arc tab 82 is positioned in a predetermined circumferential and radial location relative to the central axis of the sprinkler 10 so that the fixed arc tab 82 can be engaged by the outer end of a pointed shift toggle 86 (FIG. 9) of the reversing mechanism 13 as the reversing mechanism 13 is slowly rotated by the planetary gear drive 12.

Figure 10A:
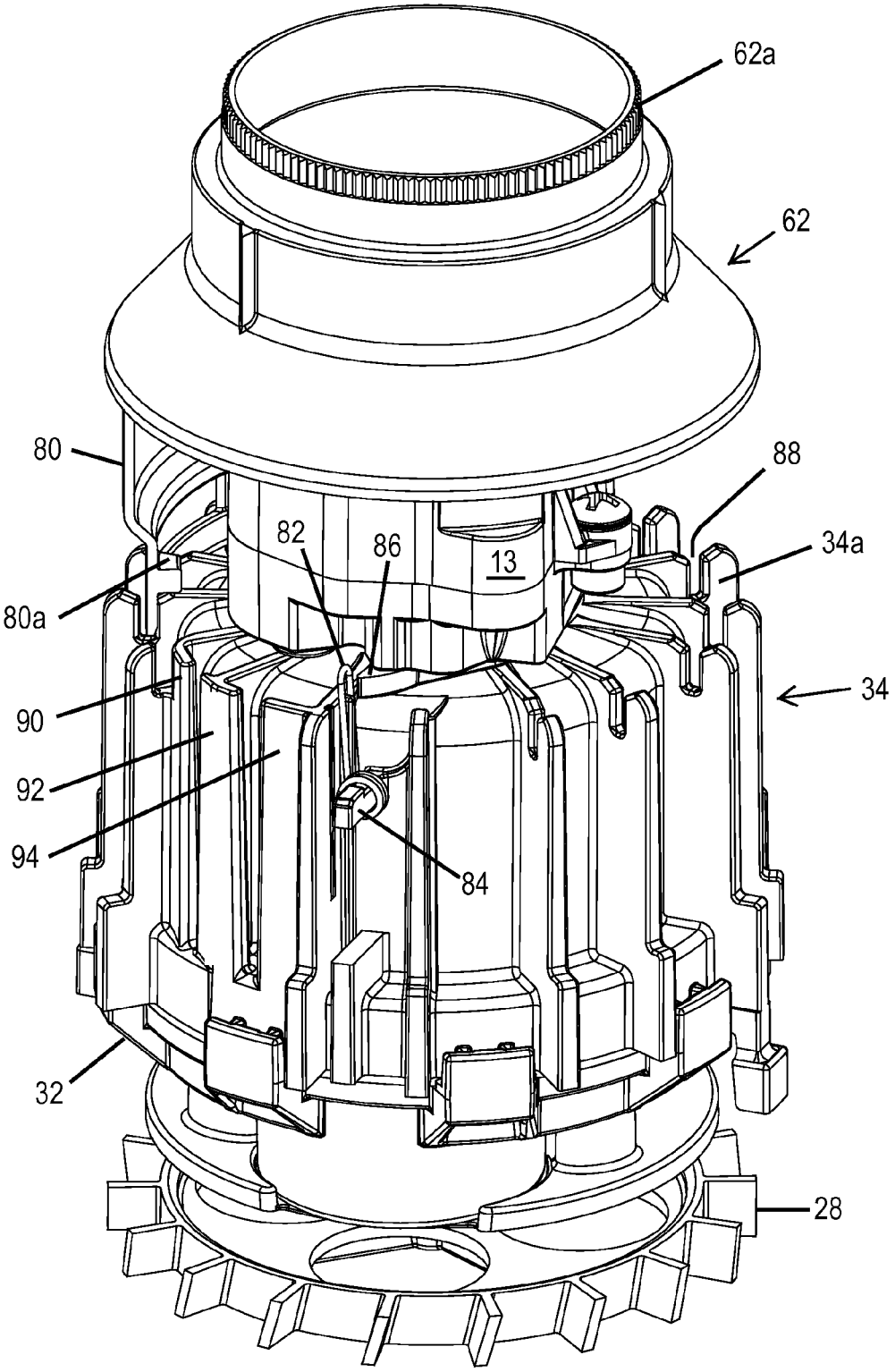
FIGS. 10A and 10B are enlarged isometric views similar to FIG. 8 illustrating the manner in which the fixed arc tab reverses the rotation of the nozzle turret when the sprinkler of FIG. 1 is in its oscillating mode.
Figure 10B:
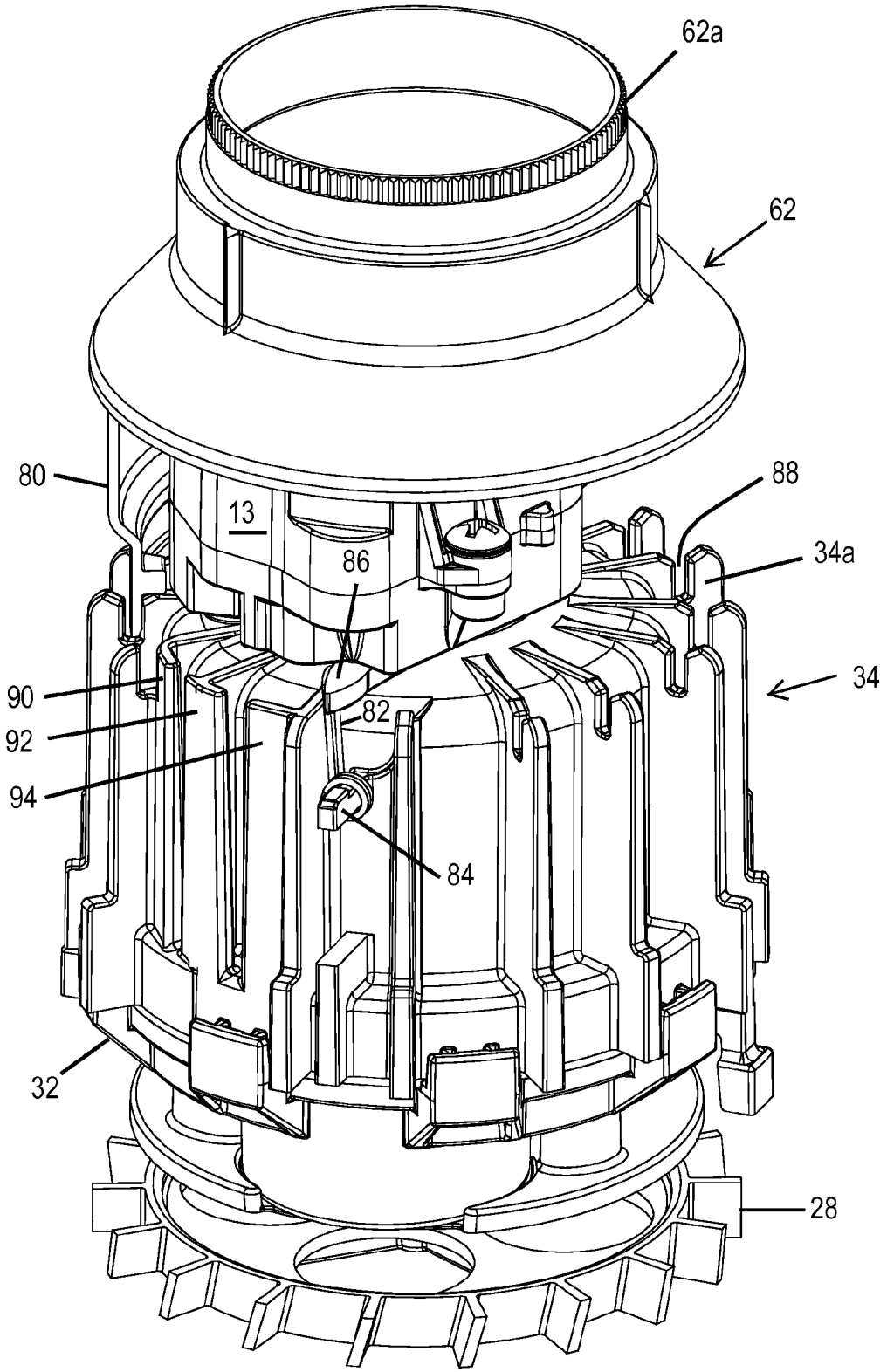
Figure 11:
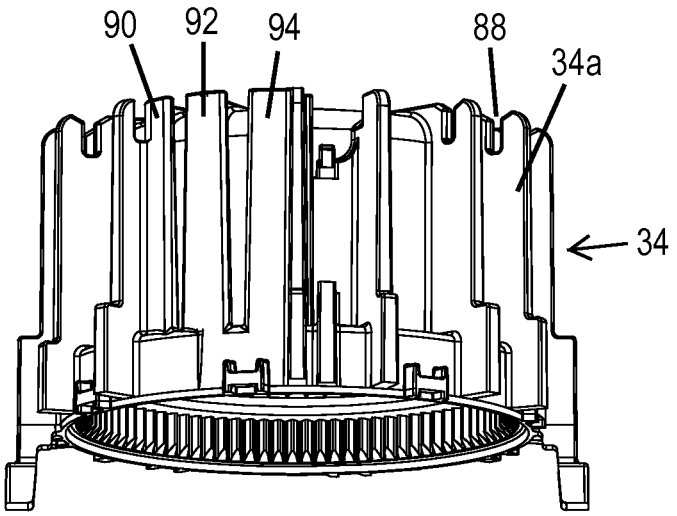
FIG. 11 is an enlarged isometric view of the upper portion of the gear box housing of the sprinkler of FIG. 1 taken from the side thereof and illustrating details of its radially extending fins and radially projecting ramps.
Figure 12:
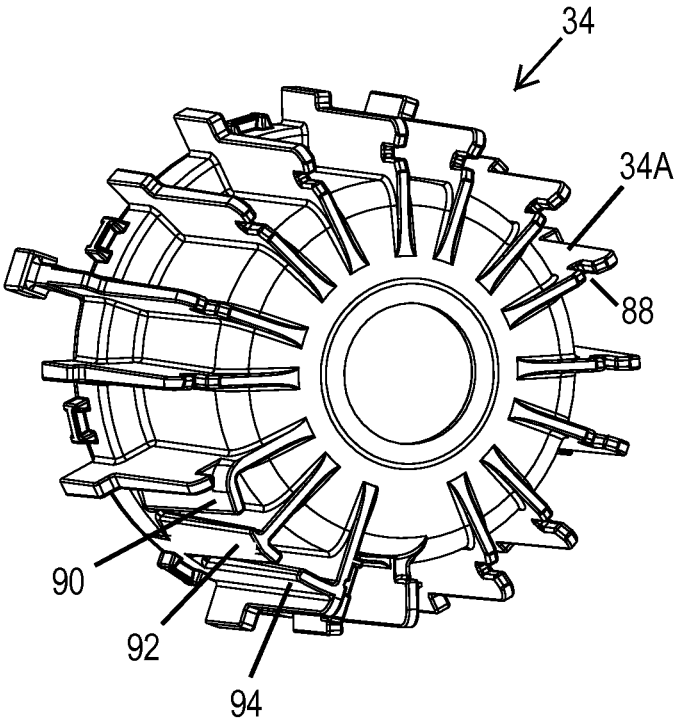
FIG. 12 is an enlarged isometric view of the upper portion of the gear box housing taken from the top side thereof illustrating the slots in the radially extending fins that guide the arcuate lower edge of the adjustable arc tab to the ramps.

When the sprinkler 10 is in its oscillating mode and the reversing mechanism 13 is rotating in a clockwise direction (viewed looking down from above the nozzle turret 26) the outer end of the shift toggle 86 will approach the fixed arc tab 82 as illustrated in FIG. 10A. As the reversing mechanism 13 continues to rotate the shift toggle 86 will eventually engage the fixed arc tab 82. Continued rotation of the reversing mechanism 13 results in pivoting of the shift toggle 86 as illustrated in FIG. 10B. The U-shaped segment 82*b* (FIG. 7) is supported in a substantially vertical orientation by engagement with one of the radially extending fins 34*a* of the gear box housing 34. When the shift toggle 86 pushes to the left in FIG. 10A against the fixed arc tab 82, the U-shaped segment 82*b* is prevented from rotating or bending by the radially extending fin 34*a* on its left in FIG. 10A. This ensures that the motion of the nozzle turret 26 is reversed. The pivoting of the shift toggle 86 causes an internal shift fork (not illustrated) inside the reversing mechanism 13 to pivot. As a result of the pivoting of the shift fork a first cam (not illustrated) inside the reversing mechanism 13 engages a shift member (not illustrated) inside the reversing mechanism 13. The first cam axially moves the shift member and the control shaft 46 connected thereto, causing the bi-level shift sun gear 48 (FIG. 2) to move axially inside the planetary gear drive 12. This reverses the direction of rotation of the reversing mechanism 13 and the nozzle turret 26 that is coupled thereto. An over-center spring (not illustrated) inside the reversing mechanism 13 ensures positive motion of the shift fork to one of its two operative positions, preventing the shift fork from sticking in the middle of its range of motion where neither of the cams is engaged with the shift member. This would undesirably cause the rotation of the nozzle turret 26 to stall, i.e. become stationary, or rotate in only one direction.

Figure 4:
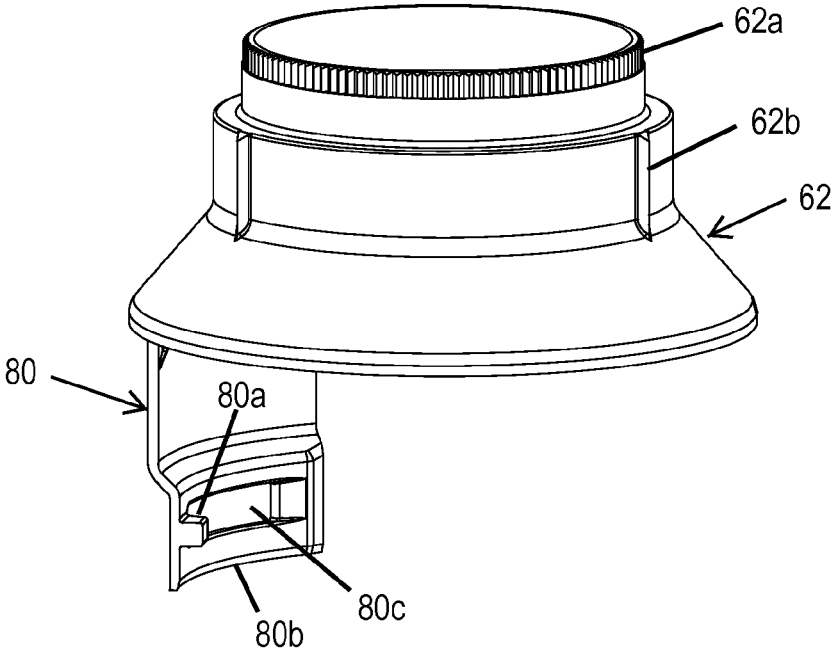
FIG. 4 is an enlarged isometric view of the carrier ring of the sprinkler of FIG. 1 illustrating details of the adjustable arc tab integrally formed therewith.
Figure 6:
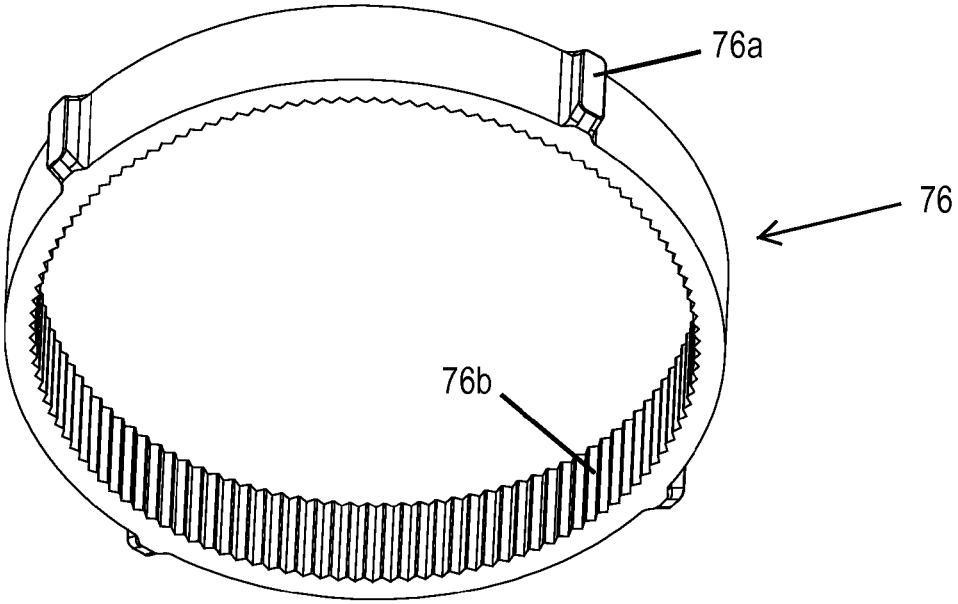
FIG. 6 is an enlarged isometric view of the coupling ring of the sprinkler of FIG. 1 taken from the bottom side thereof.
Figure 9:
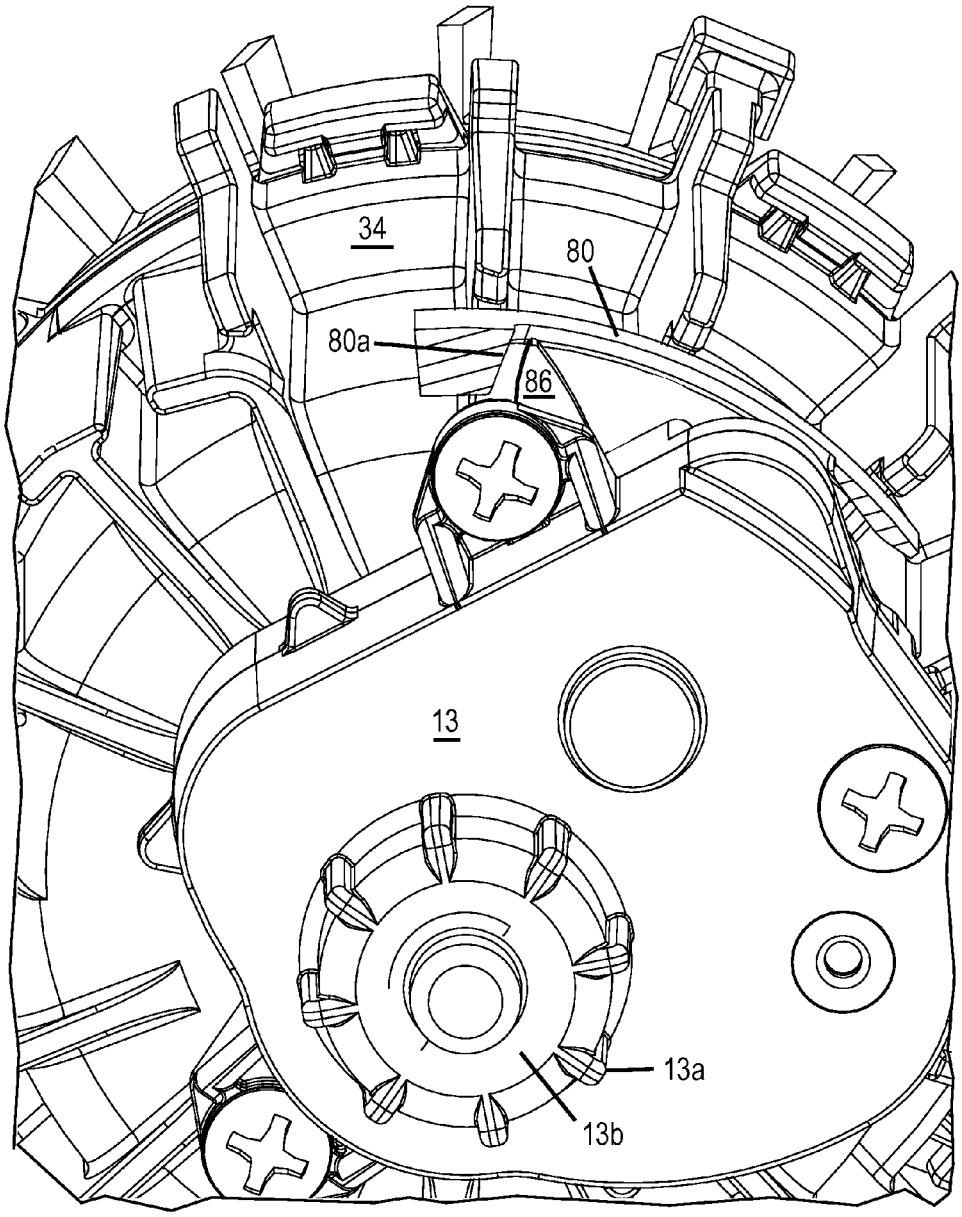
FIG. 9 is a greatly enlarged fragmentary isometric view of the top side of the reversing mechanism and the upper side of the gear box housing of the sprinkler of FIG. 1 illustrating the engagement of the shift toggle with the terminal shoulder of the adjustable arc tab. The adjustable arc tab is sectioned through a horizontal plane in this view.

A coupling ring 76 (FIG. 6) has four equally circumferentially spaced, radially projecting ribs 76*a* formed on its external annular surface. Each of the ribs 76*a* is received in a corresponding one of the internal channels (not illustrated) of the riser 22 to prevent the coupling ring 76 from rotating relative to the riser 22. The interior surface of the coupling ring 76 is formed with a plurality of radially inwardly projecting teeth 76*b* that fit between a plurality of ratchet teeth 62*b* formed on the upper end of the carrier ring 62 (FIG. 4). The ratchet teeth 62*b* snap past the radially inwardly projecting teeth 76*b* when an operator turns the side adjusting ring 72. This keeps the carrier ring 62 and adjustable arc tab 80 from rotating during normal operation of the sprinkler 10. The adjustable arc tab 80 (FIG. 4) is integrally formed with, and normally extends essentially vertically downward from the carrier ring 62 at a predetermined radial distance from the central axis of the sprinkler 10 so that in the oscillating mode the adjustable arc tab 80 can be engaged by the shift toggle 86. During counter-clockwise rotation of the reversing mechanism 13 the shift toggle 86 will eventually engage a terminal shoulder 80*a* (FIG. 4) at one end of the adjustable arc tab 80 as illustrated in FIG. 9, causing the shift toggle 86 to pivot. This reverses the direction of rotation of the nozzle turret 26 so that it once again rotates in a clockwise direction. As seen in FIG. 10B, when the shift toggle 86 once again engages the U-shaped segment 82*b* of the fixed arc tab 82, the direction of rotation of the reversing mechanism 13 and the nozzle turret 26 coupled thereto will once again reverse so that it again rotates in a counter-clockwise direction.

As previously indicated, the manually adjustable arc setting mechanism incorporated in the sprinkler 10 optionally allows the user to select continuous full circle rotation of the nozzle 14 in a uni-directional mode. This can be done by moving the adjustable arc tab 80 to a terminal circumferential position relative to the gear box housing 34 where it is radially deflected outwardly a sufficient distance to prevent the shift toggle 86 from contacting the adjustable arc tab 80. The adjustable arc tab 80 can be moved to this terminal position where it cannot be contacted by the shift toggle 86 either by manually turning the arc adjusting shaft 66 with the HUNTER tool or by manually turning the side adjusting ring 72.

Figure 13:
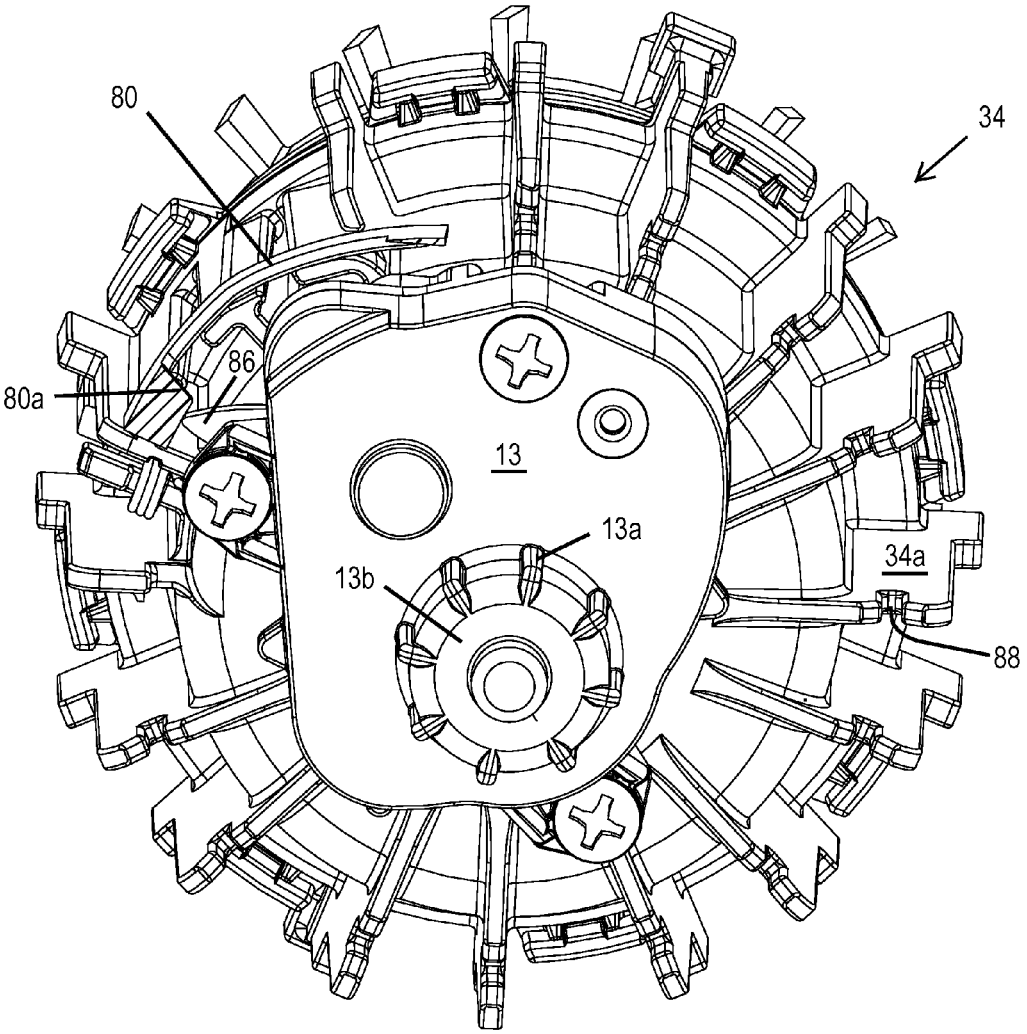
FIG. 13 is a view similar to FIG. 9 illustrating the shift toggle of the reversing mechanism clearing the shoulder of the adjustable arc tab after it has been moved to its terminal position to select full circle operation of the sprinkler of FIG. 1. The adjustable arc tab is sectioned through a horizontal plane in this view.

The bottom arcuate edge 80*b* (FIG. 4) of the adjustable arc tab 80 normally rides in a plurality of upwardly opening vertical slots 88 (FIGS. 7, 11 and 12)) formed in the upper ends of the radially extending fins 34*a* of the gear box housing 34. The upper slotted ends of the radially extending fins 34*a* form a track that guides the bottom arcuate edge 80*b* of the adjustable arc tab 80 as the arc of coverage of the sprinkler 10 is manually adjusted. The arc of coverage may be set from approximately sixty degrees to approximately two hundred and seventy degrees. As illustrated in FIGS. 10A, 10B, 11 and 12, the track formed on the gear box housing 34 also includes three axially extending, radially projecting ramps 90, 92 and 94. The ramp 90 is the first that is engaged by the leading vertical edge of the adjustable arc tab 80 when it is manually rotated by the user to its terminal position. The ramp 90 has an inclined or beveled shoulder which provides a camming surface that is positioned slightly radially outward of the center of the circular path formed by the slots 88 in the radially extending fins 34*a*. Each of the ramps 92 and 94 in turn presents an inclined or beveled shoulder with a camming surface which is positioned slightly radially further out than the camming surface of the previous shoulder. Thus the adjustable arc tab 80 flexes and bends radially outward when it is fully twisted over the ramps 90, 92 and 94 to its terminal position as illustrated in FIG. 13. When the adjustable arc tab 80 is rotated to its terminal position, the leading vertical edge of the adjustable arc tab 80 that includes the shoulder 80*a* engages one side of the radially extending fin 34*a*. This fin 34*a* provides a stop that fixes the terminal position of the adjustable arc tab 80. The U-shaped leg 82*b* of the fixed arc tab is engaged with the other side of the same radially extending fin 34*a*.

When the shift toggle 86 rotates past the adjustable arc tab 80 it clears the shoulder 80*a* if the adjustable arc tab 80 has been rotated to its terminal position as illustrated in FIG. 13. The adjustable arc tab 80 is formed with an arcuate slot 80*c* (FIG. 4). The adjustable arc tab 80 is radially deflected or bent the most on its left end in FIG. 4 when it is in its terminal position to ensure that the shift toggle 86 will clear the shoulder 80*a*. However, the remaining portion of the adjustable arc tab 80 curves progressively closer to the rotational axis of the sprinkler 10. Therefore the arcuate slot 80*c* allows the shift toggle 86 to extend into the slot 80*c* to prevent the toggle 86 from undesirably shifting.

Figure 14:
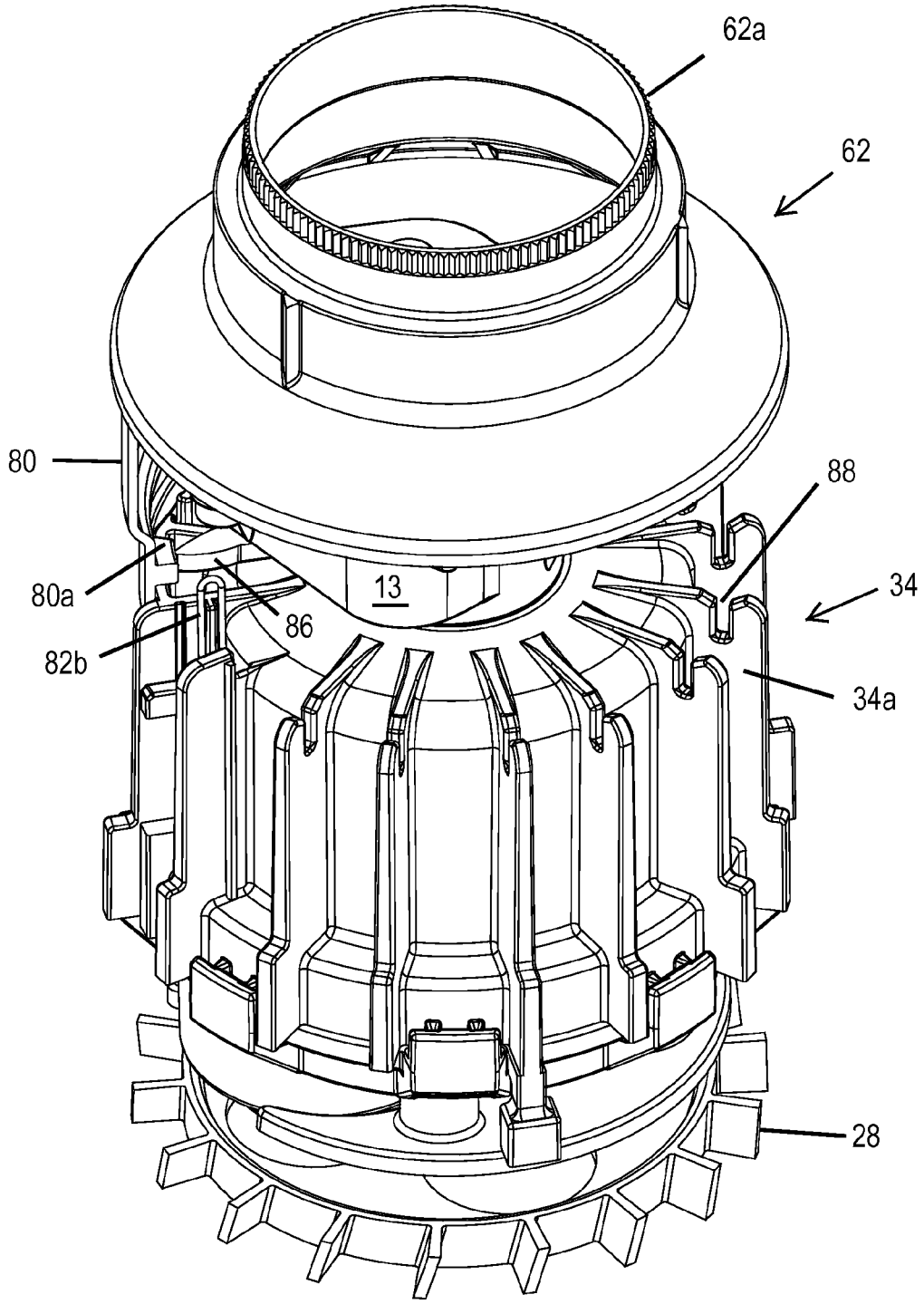
FIGS. 14 and 15 are views similar to FIG. 8 illustrating the operation of the sprinkler of FIG. 1 in its uni-directional mode.
Figure 15:
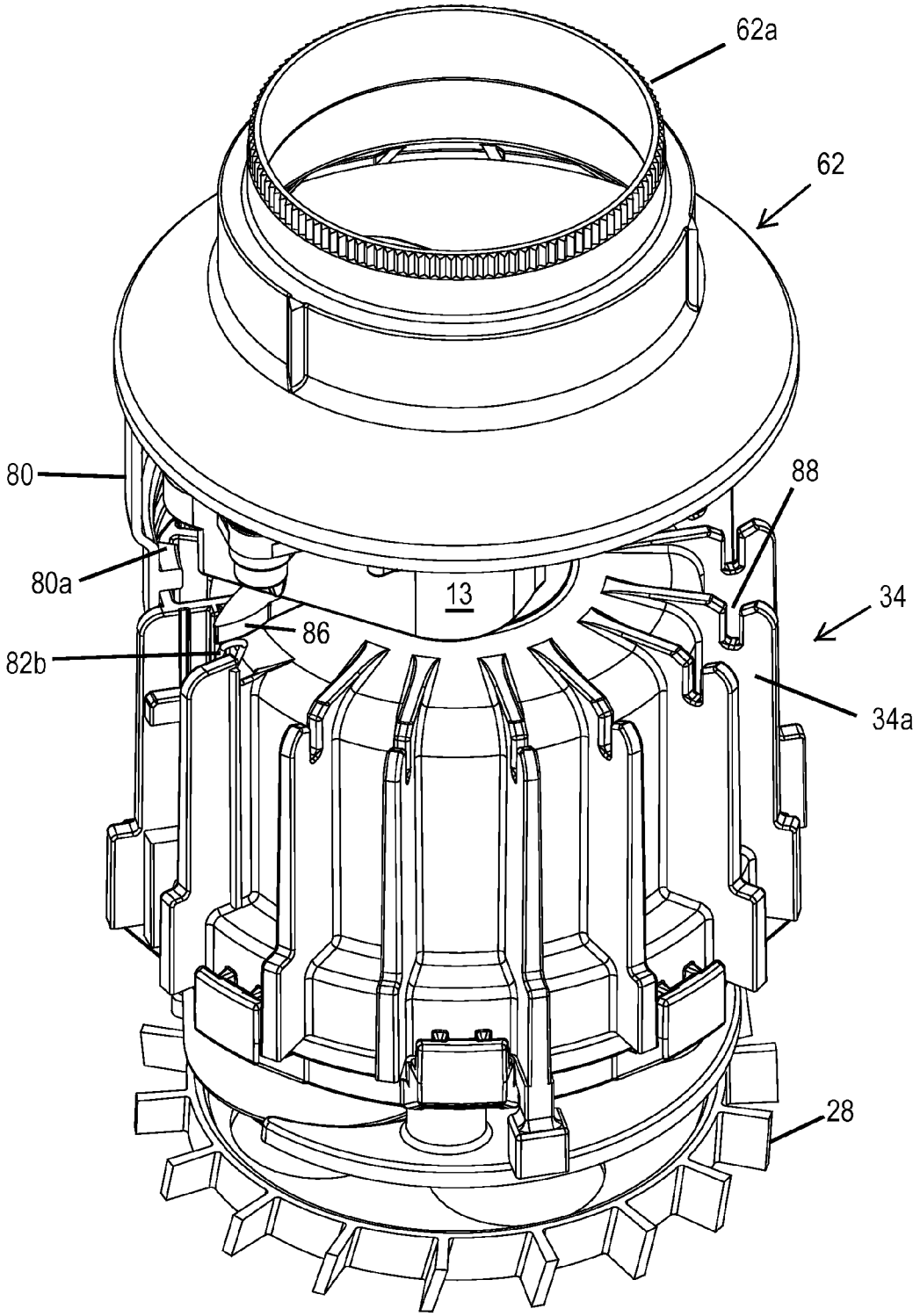
Figure 16:
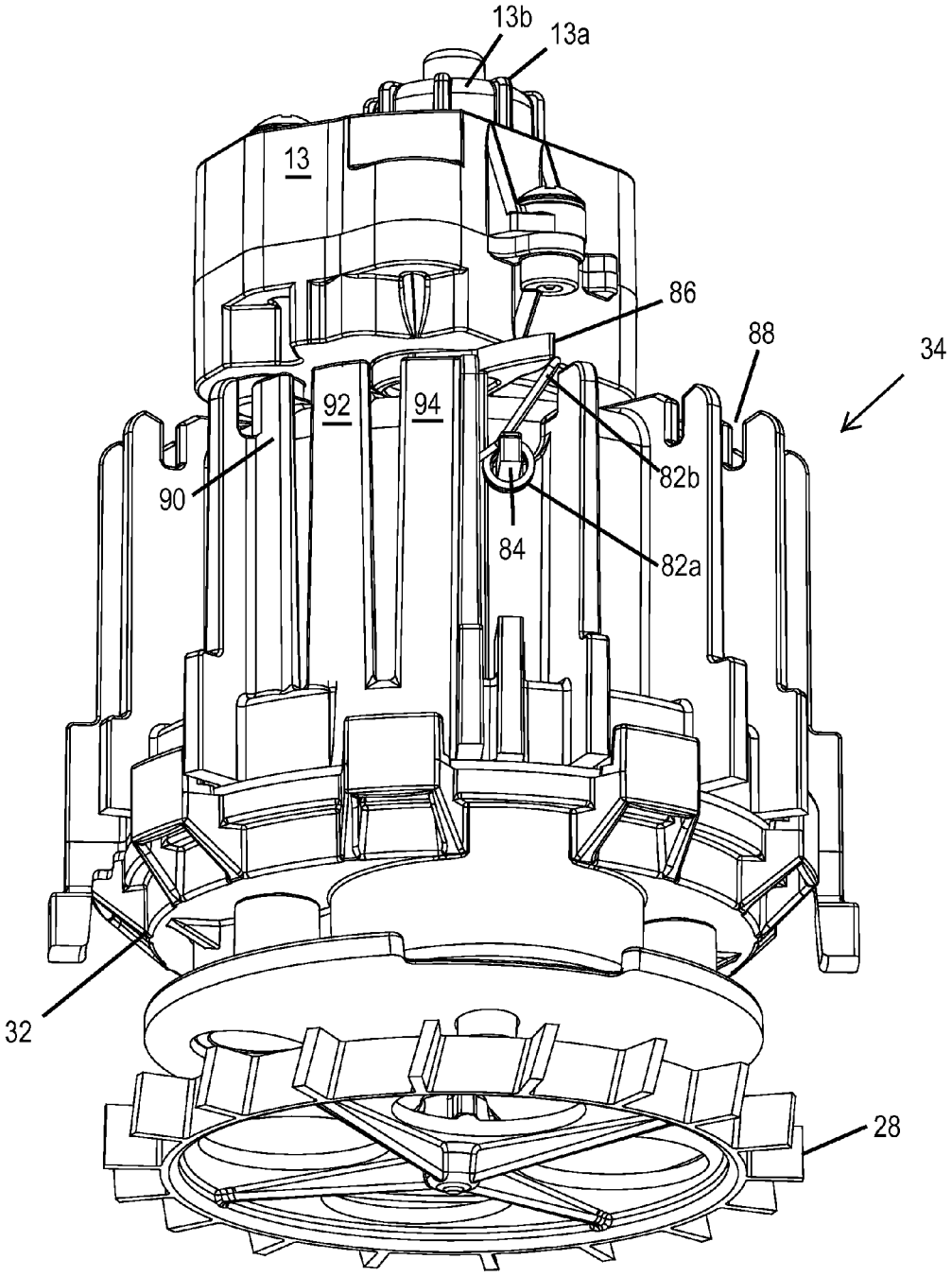
FIG. 16 is an enlarged isometric view of the turbine, gear box housing and reversing mechanism of the sprinkler of FIG. 1 taken from the side and slightly below the same. In this view the shift toggle is engaged with, and deflecting, the torsion spring that forms the fixed arc tab.

When the sprinkler 10 is in its uni-directional mode, after the toggle 86 rotates in a counter-clockwise direction past the adjustable arc tab 80 it engages the U-shaped segment 82*b* of the fixed arc tab 82 and deflects the same to the right as illustrated in FIGS. 14-16. As best seen in FIG. 16, the supporting arm 84 that carries the lower coiled segment 82*a* of the fixed arc tab 82 is positioned between two of the adjacent radially extending fins 34*a*. The supporting arm 84 is positioned sufficiently to the left in FIG. 16 to allow the upper U-shaped segment 82*b* to bend to the right a sufficient amount to allow the toggle 86 to pass over the upper end of the U-shaped segment 82*b* without shifting. The configuration and thickness of the stainless steel torsion spring that forms the fixed arc tab 82 is selected so that its spring force is insufficient to shift the toggle 86 during counter-clockwise rotation of the reversing mechanism 13 and the nozzle turret 26 coupled thereto. When the user moves the adjustable arc tab 80 to its terminal position to thereby select the full circle rotation mode of the sprinkler 10, the nozzle turret 26 may initially rotate in a clockwise direction. The toggle 86 will then engage the fixed arc tab 82 and shift as illustrated in FIG. 10B, causing the direction of the rotation of the nozzle turret 26 to reverse. The nozzle turret 26 then continuously rotates in a counter-clockwise manner until the adjustable arc tab 80 is manually twisted in a clockwise direction from its terminal position to once again select the oscillating mode.

Persons skilled in the art of installing residential and commercial irrigation systems will appreciate that the sprinkler 10 can be readily installed and its mode of operation quickly selected. The female threaded inlet 18*a* at the lower end of the outer case 18 is screwed over the male threaded segment of a riser pipe (not illustrated). Pressurized water can then be supplied to the sprinkler 10. Where a sector of turf or other landscape vegetation can be watered by selecting a sector size between about sixty and two hundred and seventy degrees the outer case 18 is rotated to set the first arc limit. Alternatively, the user can re-position the riser 22 to a different radial orientation relative to the outer case 18 to set the first arc limit. Then the user can quickly set the second arc limit in a coarse manner using the side adjusting ring 72 (FIG. 2). Fine adjustments to the arc size can be manually achieved by engaging the HUNTER tool with the upper end 78 (FIG. 3B) of the arc adjusting shaft 66, and pushing down on the tool to engage the arc adjusting gear 64 with the ring gear 70. The HUNTER tool can then be twisted to effectuate fine adjustments in the second arc limit. Typically if an area to be watered requires more than two hundred and seventy degrees of arc coverage, it can be covered by setting the sprinkler 10 to its uni-directional mode so that the nozzle 14 will rotate continuously and cover the area with water delivered in a manner that covers a full circular pattern.

While we have described and illustrated an embodiment of a reversing planetary gear sprinkler with selectable arc adjustable oscillating and full circle rotation modes, it should be understood that our invention can be modified in both arrangement and detail. For example, the sprinkler 10 could be modified to a simplified shrub configuration without the valve 16, outer case 18, and valve actuator components inside the housing 20. The radially deflectable arc tab could be incorporated into a sprinkler that utilizes a staggered gear train reduction instead of a planetary gear drive in order to provide optional full circle operation. The radially deflectable arc tab could also be incorporated into a sprinkler having pinion gears on opposite ends of pivoting frames that alternately engage a bull gear assembly. Therefore the protection afforded our invention should only be limited in accordance with the following claims.

We claim:

1. An irrigation sprinkler of the type having a reversing planetary gear drive, comprising:

a riser;

a nozzle turret rotatably mounted at an upper end of the riser;

a drive assembly supported in the riser and coupled to the nozzle turret for rotating the nozzle turret, the drive assembly having a reversing planetary gear drive, a reversing mechanism, and a manually adjustable arc setting mechanism including a pair of arc tabs, a position of one of the arc tabs being adjustable through the arc setting mechanism to change a size of an angle through which the nozzle turret oscillates back and forth, the manually adjustable arc setting mechanism further being adjustable wherein the manually adjustable arc setting mechanism includes an adjustable arc tab that is radially deflectable relative to a central axis of the sprinkler so that a shift toggle of the reversing mechanism cannot contact the adjustable arc tab to thereby allow the nozzle turret to continuously rotate.

2. The sprinkler of claim 1 wherein a portion of the manually adjustable arc setting mechanism is manually accessible from a top of the nozzle turret.

3. The sprinkler of claim 2 wherein the manually adjustable arc setting mechanism includes an arc adjusting shaft.

4. The sprinkler of claim 1 wherein a portion of the manually adjustable arc setting mechanism is manually accessible from a side of the riser.

5. The sprinkler of claim 1 wherein the adjustable arc tab is guided by a track.

6. The sprinkler of claim 1 wherein the adjustable arc tab is deflected by at least one camming surface.

7. The sprinkler of claim 1 wherein the adjustable arc tab includes a lower arcuate edge that is guided by a track that feeds to at least once camming surface that deflects the adjustable arc tab.

8. The sprinkler of claim 1 wherein the manually adjustable arc setting mechanism includes a fixed arc tab in the form of a spring.

9. The sprinkler of claim 1 wherein the spring that forms the fixed arc tab is configured and mounted to a gear box housing of the reversing planetary gear drive to allow a shift toggle of the reversing mechanism to pass over the spring without the toggle shifting to allow the nozzle turret to continuously rotate.

10. A sprinkler, comprising:

a riser;

a nozzle rotatably mounted at an upper end of the riser;

a drive assembly mounted in the riser for rotating the nozzle, the drive assembly having a reversing planetary gear drive, a reversing mechanism, and a manually adjustable arc setting mechanism that cooperates with the planetary gear drive and the reversing mechanism to allow the sprinkler to operate in an adjustable arc oscillation mode or alternatively in a uni-directional mode, wherein the manually adjustable arc setting mechanism includes an adjustable arc tab that is radially deflectable relative to a central axis of the sprinkler so that a shift toggle of the reversing mechanism cannot contact an adjustable arc tab to thereby allow the nozzle to continuously rotate.

11. The sprinkler of claim 10 wherein a portion of the manually adjustable arc setting mechanism is manually accessible from a top of a nozzle turret that encloses the nozzle.

12. The sprinkler of claim 11 wherein the manually adjustable arc setting mechanism includes an arc adjusting shaft.

13. The sprinkler of claim 10 wherein a portion of the manually adjustable arc setting mechanism is manually accessible from a side of the riser.

14. The sprinkler of claim 10 wherein the adjustable arc tab is guided by a track.

15. The sprinkler of claim 14 wherein the track includes at least one camming surface.

16. The sprinkler of claim 10 wherein the adjustable arc tab includes a lower arcuate edge that is guided by a track that includes at least once camming surface that deflects the adjustable arc tab.

17. The sprinkler of claim 10 wherein the manually adjustable arc setting mechanism includes an adjustable arc tab and a fixed arc tab.

18. An irrigation sprinkler of the type having a reversing planetary gear drive, comprising:

a riser;

a nozzle turret rotatably mounted at an upper end of the riser;

a drive assembly supported in the riser and coupled to the nozzle turret for rotating the nozzle turret, the drive assembly having a reversing planetary gear drive, a reversing mechanism, and a manually adjustable arc setting mechanism including a pair of arc tabs, a position of one of the arc tabs being adjustable through the arc setting mechanism to change a size of an angle through which the nozzle turret oscillates back and forth, the manually adjustable arc setting mechanism being further adjustable to rotate the adjustable arc tab to a terminal position with a track including a least one camming surface that radially deflects the adjustable arc tab relative to a central axis of the sprinkler so that a shift toggle of the reversing mechanism cannot contact the adjustable arc tab to thereby allow the nozzle turret to continuously rotate.

19. The sprinkler of claim 1 wherein the reversing planetary gear drive includes a shifting sun gear.

20. A sprinkler, comprising:

a riser;

a nozzle rotatably mounted at an upper end of the riser;

a drive assembly mounted in the riser for rotating the nozzle, the drive assembly having a reversing planetary gear drive, a reversing mechanism, and a manually adjustable arc setting mechanism that cooperates with the planetary gear drive and the reversing mechanism to allow the sprinkler to operate in an adjustable arc oscillation mode or alternatively in a uni-directional mode;

wherein the manually adjustable arc setting mechanism includes an adjustable arc tab that is radially deflectable relative to a central axis of the sprinkler so that a shift toggle of the reversing mechanism cannot contact an adjustable arc tab to thereby allow the nozzle to continuously rotate.

* * * * *